US007921520B2

(12) United States Patent
Bossmann

(10) Patent No.: US 7,921,520 B2
(45) Date of Patent: Apr. 12, 2011

(54) APPARATUS FOR THE FIBRE-SORTING OR FIBRE-SELECTION OF A FIBRE BUNDLE COMPRISING TEXTILE FIBRES, ESPECIALLY FOR COMBING

(75) Inventor: Johannes Bossmann, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 357 days.

(21) Appl. No.: 12/163,668

(22) Filed: Jun. 27, 2008

(65) Prior Publication Data

US 2009/0000074 A1 Jan. 1, 2009

(30) Foreign Application Priority Data

Jun. 29, 2007 (DE) ..... 10 2007 030 393
Jun. 29, 2007 (DE) ..... 10 2007 030 471
Jun. 29, 2007 (DE) ..... 20 2007 010 686 U
Jan. 11, 2008 (DE) ..... 10 2008 004 096

(51) Int. Cl.
*D01G 19/00* (2006.01)

(52) U.S. Cl. ..... 19/233

(58) Field of Classification Search ..... 19/115 R–235
See application file for complete search history.

(56) References Cited

U.S. PATENT DOCUMENTS 1,408,780 A 3/1922 Schleifer
1,425,059 A 8/1922 Schleifer
1,694,432 A 12/1928 Schleifer
1,708,032 A 4/1929 Schleifer
1,715,473 A 6/1929 Schleifer
1,799,066 A 3/1931 Schleifer
2,044,460 A 6/1936 Bartram et al.
2,962,772 A 12/1960 Draving et al.
3,108,333 A 10/1963 Schleifer
4,270,245 A 6/1981 Stewart et al.
5,007,623 A 4/1991 Unkuri et al.
5,343,686 A 9/1994 Buchner et al.
(Continued)

FOREIGN PATENT DOCUMENTS

DE 367482 C 1/1923
(Continued)

OTHER PUBLICATIONS

German Patent Office Search Report, dated Aug. 8, 2007, issued in related German Application No. 10 2006 050 384.8, and English language translation of Section C.

(Continued)

*Primary Examiner* — Shaun R Hurley
(74) *Attorney, Agent, or Firm* — Venable LLP; Robert Kinberg; Steven J. Schwarz

(57) ABSTRACT

In an apparatus for the fiber-sorting or fiber-selection of a fiber bundle comprising textile fibers, especially for combing, clamping devices are provided which clamp the fiber bundle at a distance from its free end, and a mechanical arrangement is present which generates a combing action from the clamping site to the free end, in order to loosen and remove non-clamped constituents. To enable productivity to be substantially increased in a simple manner and an improved combed sliver to be obtained, downstream of the supply device there are arranged at least two rotatably mounted rollers, clamping devices being distributed spaced apart in the region of at least one said roller's periphery, and the arrangement for generating a combing action is inside the roller.

25 Claims, 4 Drawing Sheets

U.S. PATENT DOCUMENTS

| | | | |
|---|---|---|---|
| 5,404,619 | A | 4/1995 | Jorg |
| 5,457,851 | A | 10/1995 | Mondini |
| 5,502,875 | A | 4/1996 | Stolz et al. |
| 5,796,220 | A | 8/1998 | Clapp et al. |
| 6,163,931 | A | 12/2000 | Leifeld |
| 6,173,478 | B1 | 1/2001 | Patelli et al. |
| 6,216,318 | B1 | 4/2001 | Leifeld |
| 6,235,999 | B1 | 5/2001 | Rubenach |
| 6,295,699 | B1 | 10/2001 | Temburg |
| 6,499,194 | B1 | 12/2002 | Gresser et al. |
| 6,611,994 | B2 | 9/2003 | Bischofberger et al. |
| 7,173,207 | B2 | 2/2007 | Losbrock et al. |
| 2002/0124354 | A1 | 9/2002 | Pferdmenges et al. |
| 2003/0005551 | A1 | 1/2003 | Schurenkramer et al. |
| 2003/0029003 | A1 | 2/2003 | Breuer et al. |
| 2003/0070260 | A1 | 4/2003 | Rubenach |
| 2003/0154572 | A1 | 8/2003 | Pferdmenges et al. |
| 2004/0040121 | A1 | 3/2004 | Schmitz |
| 2004/0128799 | A1 | 7/2004 | Hosel et al. |
| 2005/0076476 | A1 | 4/2005 | Temburg |
| 2005/0198783 | A1 | 9/2005 | Rubenach |
| 2005/0278900 | A1 | 12/2005 | Dammig |
| 2006/0260100 | A1 | 11/2006 | Duda et al. |
| 2007/0180658 | A1 | 8/2007 | Saeger et al. |
| 2007/0180659 | A1 | 8/2007 | Saeger et al. |
| 2007/0180660 | A1 | 8/2007 | Saeger et al. |
| 2007/0266528 | A1 | 11/2007 | Farber et al. |
| 2008/0092339 | A1 | 4/2008 | Bossman et al. |
| 2009/0000064 | A1 | 1/2009 | Saeger et al. |
| 2009/0000065 | A1 | 1/2009 | Saeger et al. |
| 2009/0000066 | A1 | 1/2009 | Saeger et al. |
| 2009/0000067 | A1 | 1/2009 | Leder et al. |
| 2009/0000068 | A1 | 1/2009 | Saeger et al. |
| 2009/0000069 | A1 | 1/2009 | Saeger et al. |
| 2009/0000070 | A1 | 1/2009 | Saeger et al. |
| 2009/0000071 | A1 | 1/2009 | Saeger et al. |
| 2009/0000072 | A1 | 1/2009 | Saeger et al. |
| 2009/0000073 | A1 | 1/2009 | Saeger et al. |
| 2009/0000075 | A1 | 1/2009 | Saeger et al. |
| 2009/0000076 | A1 | 1/2009 | Bossmann et al. |
| 2009/0000077 | A1 | 1/2009 | Saeger et al. |
| 2009/0000078 | A1 | 1/2009 | Saeger et al. |
| 2009/0000079 | A1 * | 1/2009 | Bossmann ..... 19/80 A |

FOREIGN PATENT DOCUMENTS

| | | | |
|---|---|---|---|
| DE | 382169 | C | 9/1923 |
| DE | 399885 | C | 7/1924 |
| DE | 489 420 | C | 1/1930 |
| DE | 30 48 501 | A1 | 7/1982 |
| DE | 103 20 452 | A1 | 11/2004 |
| EP | 1 586 682 | A | 10/2005 |
| WO | WO-2006/012758 | A1 | 2/2006 |

OTHER PUBLICATIONS

German Patent Office Search Report, dated Oct. 20, 2006, Issued in related German Patent Application No. 10 2006 050 453.4, and partial English-language translation.

U.S. Office Action dated Feb. 26, 2010, issued in related U.S. Appl. No. 12/149,506.

* cited by examiner

APPARATUS FOR THE FIBRE-SORTING OR FIBRE-SELECTION OF A FIBRE BUNDLE COMPRISING TEXTILE FIBRES, ESPECIALLY FOR COMBING

CROSS REFERENCE TO RELATED APPLICATIONS

This application claims priority from German Patent Application No. 10 2007 030 393.0 dated Jun. 29, 2007, German Utility Model No. 20 2007 010 686.6 dated Jun. 29, 2007, and German Patent Application No. 10 2008 004 096.7 dated Jan. 11, 2008, the entire disclosure of each of which is incorporated herein by reference.

BACKGROUND OF THE INVENTION

The invention relates to an apparatus for the fibre-sorting or selection of a fibre bundle comprising textile fibres, especially for combing, which is supplied by means of supply means to a fibre-sorting device, especially to a combing device. It is known in a combing device to provide clamping devices, which clamp the fibre sliver at a distance from its free end, mechanical means being present which generate a combing action from the clamping site to the free end of the fibre sliver in order to loosen and remove non-clamped constituents, such as, for example, short fibres, neps, dust and the like from the free end, and a clamping element being present to take up the supplied fibre material.

In practice, combing machines are used to free cotton fibres or woollen fibres of natural impurities contained therein and to parallelise the fibres of the fibre sliver. For that purpose, a previously prepared fibre bundle is clamped between the jaws of the nipper arrangement so that a certain sub-length of the fibres, known as the "fibre tuft" (also referred to herein as "fibre bundle"), projects at the front of the jaws. By means of the combing segments of the rotating combing roller, which segments are filled with needle clothing or toothed clothing, this fibre tuft is combed and thus cleaned. The take-off device usually consists of two counter-rotating rollers, which grip the combed fibre tuft and carry it onwards. The known cotton-combing process is a discontinuous process. During a nipping operation, all assemblies and their drive means and gears are accelerated, decelerated and in some cases reversed again. High nip rates result in high acceleration. Particularly as a result of the kinematics of the nippers, the gear for the nipper movement and the gear for the pilgrim-step movement of the detaching rollers, high acceleration forces come into effect. The forces and stresses that arise increase as the nip rates increase. The known flat combing machine has reached a performance limit with its nip rates, which prevents productivity from being increased. Furthermore, the discontinuous mode of operation causes vibration in the entire machine, which generates dynamic alternating stresses.

EP 1 586 682 A discloses a combing machine in which, for example, eight combing heads operate simultaneously one next to the other. The drive of those combing heads is effected by means of a lateral drive means arranged next to the combing heads having a gear unit, which is in driving connection by way of longitudinal shafts with the individual elements of the combing heads. The fibre slivers formed at the individual combing heads are transferred, one next to the other on a conveyor table, to a subsequent drafting system in which they are drafted and then combined to form a common combing machine sliver. The fibre sliver produced in the drafting system is then deposited in a can by means of a funnel wheel (coiler plate). The plurality of combing heads of the combing machine each have a feed device, a pivotally mounted, fixed-position nipper assembly, a rotatably mounted circular comb having a comb segment for combing out the fibre tuft supplied by the nipper assembly, a top comb and a fixed-position detaching device for detaching the combed-out fibre tuft from the nipper assembly. The lap ribbon supplied to the nipper assembly is here fed via a feed cylinder to a detaching roller pair. The fibre tuft protruding from the opened nipper passes onto the rearward end of a combed sliver web or fibre web, whereby it enters the clamping nip of the detaching rollers owing to the forward movement of the detaching rollers. The fibres that are not retained by the retaining force of the lap ribbon, or by the nipper, are detached from the composite of the lap ribbon. During this detaching operation, the fibre tuft is additionally pulled by the needles of a top comb. The top comb combs out the rear part of the detached fibre tuft and also holds back neps, impurities and the like. Owing to the differences in speed between the lap ribbon and the detaching speed of the detaching rollers, the detached fibre tuft is drawn out to a specific length. Following the detaching roller pair is a guide roller pair. During this detaching operation, the leading end of the detached or pulled off fibre bundle is overlapped or doubled with the trailing end of the fibre web. As soon as the detaching operation and the piecing operation have ended, the nipper returns to a rear position in which it is closed and presents the fibre tuft protruding from the nipper to a comb segment of a circular comb for combing out. Before the nipper assembly now returns to its front position again, the detaching rollers and the guide rollers perform a reversing movement, whereby the trailing end of the fibre web is moved backwards by a specific amount. This is required to achieve a necessary overlap for the piecing operation. In this way, a mechanical combing of the fibre material is effected. Disadvantages of that combing machine are especially the large amount of equipment required and the low hourly production rate. There are eight individual combing heads which have in total eight feed devices, eight fixed-position nipper assemblies, eight circular combs with comb segments, eight top combs and eight detaching devices. A particular problem is the discontinuous mode of operation of the combing heads. Additional disadvantages result from large mass accelerations and reversing movements, with the result that high operating speeds are not possible. Finally, the considerable amount of machine vibration results in irregularities in the deposition of the combed sliver. Moreover, the ecartement, that is to say the distance between the nipper lip of the lower nipper plate and the clamping point of the detaching cylinder, is structurally and spatially limited. The rotational speed of the detaching rollers and the guide rollers, which convey the fibre bundles away, is matched to the upstream slow combing process and is limited by this. A further drawback is that each fibre bundle is clamped and conveyed by the detaching roller pair and subsequently by the guide roller pair. The clamping point changes constantly owing to the rotation of the detaching rollers and the guide rollers, i.e. there is a constant relative movement between the rollers effecting clamping and the fibre bundle. All fibre bundles have to pass through the one fixed-position detaching roller pair and the one fixed-position guide roller pair in succession, which represents a further considerable limitation of the production speed.

SUMMARY OF THE INVENTION

It is an aim of the invention to provide an apparatus of the kind described at the beginning which avoids or mitigates the mentioned disadvantages and which in a simple way, in particular, enables the amount produced per hour (productivity) to be substantially increased and an improved combed sliver to be obtained.

The invention provides an apparatus for the fibre-sorting or fibre-selection of a fibre bundle comprising textile fibres having:

a fibre-sorting device;

a supply device for supplying the fibre bundle to the fibre-sorting device; and at least one mechanical device for generating a combing action in order to loosen and remove non-clamped constituents from the fibre bundle;

wherein the fibre-sorting device comprises, arranged downstream of the supply device, at least two rotatably mounted rollers that, in use, rotate rapidly without interruption, at least one of said at least two rollers having clamping devices distributed spaced apart in the region of its periphery, and the device for generating a combing action is arranged inside a said rotatably mounted roller.

By implementing the functions of clamping and moving the fibre bundles to be combed-out on rotating rollers, high operating speeds (nip rates) are achievable—unlike the known apparatus—without large mass accelerations and reversing movements. In particular, the mode of operation is continuous. When high-speed rollers are used, a very substantial increase in hourly production rate (productivity) is achievable which had previously not been considered possible in technical circles. A further advantage is that the rotary rotational movement of the roller with the plurality of clamping devices leads to an unusually rapid supply of a plurality of fibre bundles per unit of time to the first roller and to the second roller. In particular the high rotational speed of the rollers allows production to be substantially increased. To form the fibre bundle, the fibre sliver pushed forward by the feed roller is clamped at one end by a clamping device and detached by the rotary movement of the turning rotor. The clamped end contains short fibres, the free region comprises the long fibres. The long fibres are pulled by separation force out of the fibre material clamped in the feed nip, short fibres remaining behind through the retaining force in the feed nip. Subsequently, as the fibre bundle is transferred from the turning rotor onto the combing rotor the ends of the fibre bundle are reversed: the clamping device on the combing rotor grips and clamps the end with the long fibres, so that the region with the short fibres projects from the clamping device and lies exposed and can thereby be combed out.

The fibre bundles are—unlike the known apparatus—held by a plurality of clamping devices and transported under rotation. The clamping point at the particular clamping devices therefore remains constant until the fibre bundles are transferred to the first or second rollers, respectively. A relative movement between clamping device and fibre bundle does not begin until after the fibre bundle has been gripped by the first or second roller, respectively, and in addition clamping has been terminated. Because a plurality of clamping devices is available for the fibre bundles, in an especially advantageous manner fibre bundles can be supplied to the first or second roller respectively one after the other and in quick succession, without undesirable time delays resulting from just a single supply device. A particular advantage comprises a structural simplification. An additional assembly can be saved. By integration of the combing function within second roller, which is preferably the combing rotor, a compact method of construction is achieved. The movement of the combing elements is achievable, for example, by a continuous, preferably uniform, rotation. A further technological advantage is that the fibre tuft ends on the fibre bundles are unable to avoid the combing operation. The combing speed (relative speed between fibre tuft ends and combing element) is—in contrast to the known device—lower despite the higher nip rate.

Advantageously, the clamping devices co-operate with the means for generating a combing action (combing elements). In a preferred embodiment, a first and a second roller are arranged downstream of the supply device and the means for generating a combing action (for example, combing elements) are arranged in the second roller, which may especially be a combing rotor. Advantageously, the first roller (which preferably acts as a turning rotor) is arranged between the supply device and the second roller.

In some embodiments, each combing element rotates about its own pivot point. As well or instead, all combing elements may rotate about the pivot point of the combing rotor. Thus, advantageously, the combing elements rotate in a planetary motion around their own pivot point and around the pivot point of the combing rotor. Advantageously, the combing elements are mounted on the combing rotor. The combing elements may be arranged, for example, on a rotating roller. Where present, the rotating roller is advantageously arranged inside the combing rotor. Advantageously, the axes of rotation of the rotating roller and the combing rotor are arranged concentrically with respect to one another. Advantageously, one or more of the clamping devices has a gripper nipper that is mounted so as to perform rotary movement. There may be associated with the gripper nipper a counter-element. In certain embodiments, the counter-element is immovably mounted. In other embodiments, the counter-element may be mounted so as to perform rotary movement. Advantageously, the axes of rotation of the gripper nipper and the counter-element are arranged concentrically with respect to one another. Advantageously, each gripper nipper is rotatable or rotates about its own pivot point.

The clamping devices of the second roller advantageously comprise a nipper pair, that is, a gripper nipper and a counter-element. Advantageously, each nipper pair (gripper nipper and counter-element) rotates about its own pivot point. Advantageously, all gripper nippers rotate about the pivot point of the combing rotor. Preferably, the nipper pairs rotate in a planetary motion around their own pivot point and around the pivot point of the combing rotor. Advantageously, the nipper pairs are mounted on the combing rotor. Advantageously, at least one combing element is associated with each nipper device. The combing element may have a combing clothing on parts of its periphery. The combing element may have a combing clothing on its entire periphery (clothed roller). The combing elements may be, for example, circular combs.

Advantageously, there is a piecing roller downstream of the combing rotor and the fibre bundle clamped in the nipper device can be combed out by the combing element before the piecing roller is reached. Advantageously, the combing elements rotate continuously. Advantageously, the combing elements rotate uniformly. Advantageously, the angular position of the combing elements on their axis of rotation is co-ordinated as a function of the combing roller position with the free movement of the movable nipper. In some embodiments, a gripper element movable in rotation and a rotatable combing element are arranged side by side. In other embodiments, an immovable gripper element and a clothed combing roller are arranged side by side. The combing elements may be rotatable. In that case, a wheel gear is advantageously used for rotation of the combing elements, for example, for rotation of the combing rollers. Advantageously, the wheel gear is driven by the combing rotor. Advantageously, a cleaning device, e.g.

rotating cleaning rollers, is associated with the combing elements and/or the combing rollers. In a preferred embodiment, a further roller that is equipped with a plurality of combing elements rotates inside the combing rotor. The further roller may be mounted concentrically with respect to the axis of the combing rotor. Instead, the further roller may be mounted eccentrically with respect to the combing rotor.

Advantageously, the further roller rotates continuously and/or the further roller rotates uniformly. Where present, the further roller and the combing rotor may have the same direction of rotation (synchronous running), or the further roller and the combing rotor may have different directions of rotation (counter-rotation).

In certain preferred embodiments in which there are present clamping devices that comprise nipper devices comprising upper nipper and lower nippers, the nipper devices in the closed state advantageously present the clamped fibre tufts to the combing elements for combing.

The arrangement is advantageously such that the fibre tuft is combable by the relative movement between fibre tuft and combing element or combing roller clothing respectively. Advantageously, a cleaning device, e.g. at least one rotating cleaning roller, for cleaning the combing elements and the combing roller clothings is arranged inside the combing rotor.

Where there is a further roller carrying combing elements that rotates inside the combing rotor, the speed ratio between combing rotor and the further roller having the combing elements is advantageously greater than 1 during same-direction combing.

Advantageously, the turning rotor and the combing rotor have opposite directions of rotation. Advantageously, for suction of the supplied fibre bundles at least one suction device is associated with the clamping devices in the region of the delivery of the fibre sliver from the supply means to the first roller and/or in the region of the delivery of the fibre material from the first roller to the second roller.

The invention further provides an apparatus for the fibre-sorting or fibre-selection of a fibre bundle comprising textile fibres, especially for combing, which is supplied by means of supply means to a fibre-sorting device, especially a combing device, in which clamping devices are provided which clamp the fibre bundle at a distance from its free end, and mechanical means are present which generate a combing action from the clamping site to the free end of the fibre bundle, in order to loosen and remove non-clamped constituents, such as, for example, short fibres, neps, dust and the like from the free end, wherein for transfer of the supplied fibre material a clamping element is present, in which downstream of the supply means there are arranged at least two rotatably mounted rollers rotating rapidly without interruption which are provided with clamping devices for the fibre sliver transported in rotation, which clamping devices are distributed spaced apart in the region of the rollers' peripheries, and the means for generating a combing action (combing elements) are arranged inside the roller.

DETAILED DESCRIPTION OF CERTAIN PREFERRED EMBODIMENTS

Figure 1:
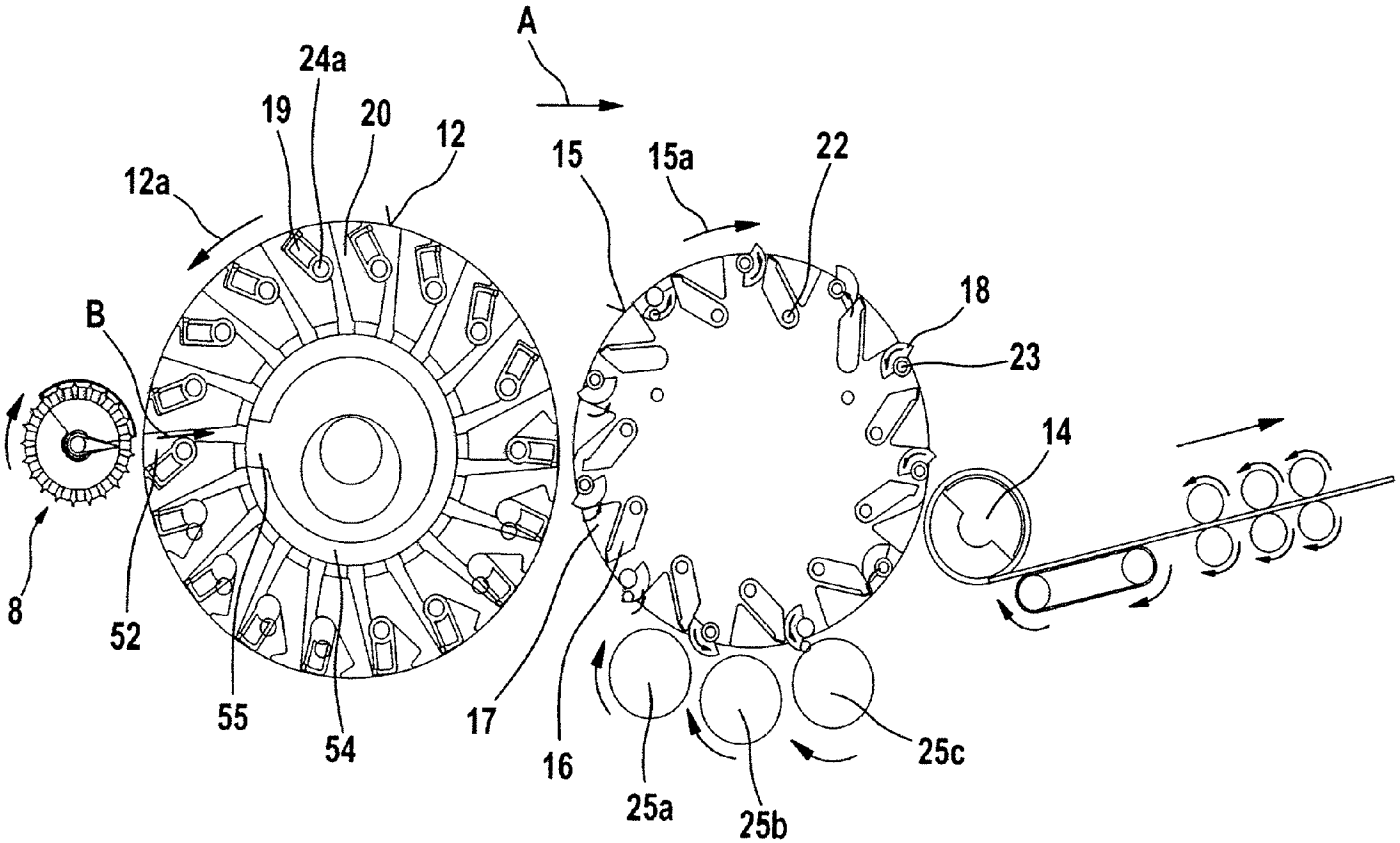
FIG. 1 is a diagrammatic side view of a rotor combing machine according to the invention having two rollers, in which nipper devices are present on the first roller and the combing elements are arranged inside and on the second roller (combing rotor)

FIG. 1 shows a rotor combing machine 2 having a supply device 8, a first roller 12 (turning rotor), a second roller 15 (combing rotor), and a take-off device comprising a take-off roller 14. The directions of rotation of the rollers 12 and 15 are shown by curved arrows 12*a* and 15*a*, respectively. The rollers 12, 15 and 14 are arranged one after the other. Arrow A denotes the operating direction.

Referring to FIG. 1, the rotatably mounted first roller 12 is provided in the region of its outer periphery with a plurality of first clamping devices which extend across the width of the roller 12 and each consist of an upper nipper 19 (gripping element) and a lower nipper 20 (counter-element). In its one end region facing the centre point or the pivot axis of the roller 12, each upper nipper 19 is rotatably mounted on a pivot bearing 24*a*, which is attached to the roller 12. The lower nipper 20 is mounted on the roller 12 so to be fixed. The free end of the upper nipper 19 faces the periphery of the roller 12. The upper nipper 19 and the lower nipper 20 co-operate so that they are able to grip a fibre bundle (clamping) and release it. Suction devices 52 are associated with the clamping devices 19, 20 of the first roller 12. In the region of the delivery between the supply device 8 and the roller 12 and in the region of the delivery between the roller 12 and the roller 15, the suction channels 52 (suction openings) influence the alignment and movement of the fibres to be transported. In that way, the time for the taking up of the fibre material from the supply device 8 onto the first roller 12 and the delivery from the first roller 12 to the second roller 15 is significantly reduced, so that the nip rate can be increased. The suction openings 52 are arranged within the roller 12 and rotate with the roller 12. At least one suction opening 52 is associated with each clamping device 19, 20 (nipper device). The suction openings 52 are each arranged between a gripping element (upper nipper) and counter-element (lower nipper). In the interior of the rotor 12 there is a reduced pressure region, which generates the suction flow B at the suction openings 52. The reduced pressure can be generated by connecting to a flow-generating machine. The suction flow at the individual suction openings 52 can be so switched between reduced pressure region and suction opening that it is applied only at particular selected angular positions on the roller circumference. For the purpose of the switching, valves or a valve pipe 54 with openings 55 in the corresponding angular positions can be used. The release of the suction flow B may also be brought about by the movement of the gripping element (upper nipper). Furthermore, it is possible to arrange a region of reduced pressure only at the corresponding angular positions. The suction flow B is able to promote and shorten the time for not only the deflection, but also the separation process between lap and fibre tuft to be detached in the region of the supply device 8.

Subsequently the fibre bundle is delivered to the second roller 15 (combing rotor). The second roller 15 is provided in the region of its periphery with a plurality of clamping devices, which extend across the width of the roller 15 and each consist of an upper nipper 16 (gripping element) and a lower nipper 17 (counter-element). In its one end region facing the centre point or the pivot axis of the roller 15, each upper nipper 16 is rotatably mounted on a pivot bearing 22, which is attached to the roller 15. The lower nipper 17 is fixedly mounted on the roller 15. The free end of the upper nipper 16 faces the periphery of the roller 15. The upper nipper 16 and the lower nipper 17 co-operate so that they are able to grip a fibre bundle (clamping) and release it. Associated with each nipper device 16, 17 on the combing roller 15 (combing rotor) is at least one clothed combing element 18 (see FIG. 4), which is rotatably mounted on the combing roller 15 (pivot bearing 23). The fibre tuft clamped in the nipper device is combed out by this combing element 18 before the piecing roller 14 is reached. The combing elements 18 may be circular combs. The combing elements 18 can rotate continuously and uniformly. The angular position of the combing elements 18 on their axis of rotation as a function of the combing roller position changes in such a way that the movement of the movable nipper 16 is not obstructed. The rotation of the combing elements 18 in the direction 36*a* can be generated by a simple wheel gear, which is driven by the rotary movement of the combing roller 15. At the periphery of the combing roller 15 there is a cleaning device, e.g. rotating cleaning rollers 25*a*, 25*b*, 25*c*, which clean the combing elements 18. To avoid obstructing the nipper movement, the arrangement of gripper element 16 (upper nipper) and counter-element 17 (lower nipper) can be interchanged. Then, instead of the combing elements 18, a fully clothed roller could also be used.

Figure 2:
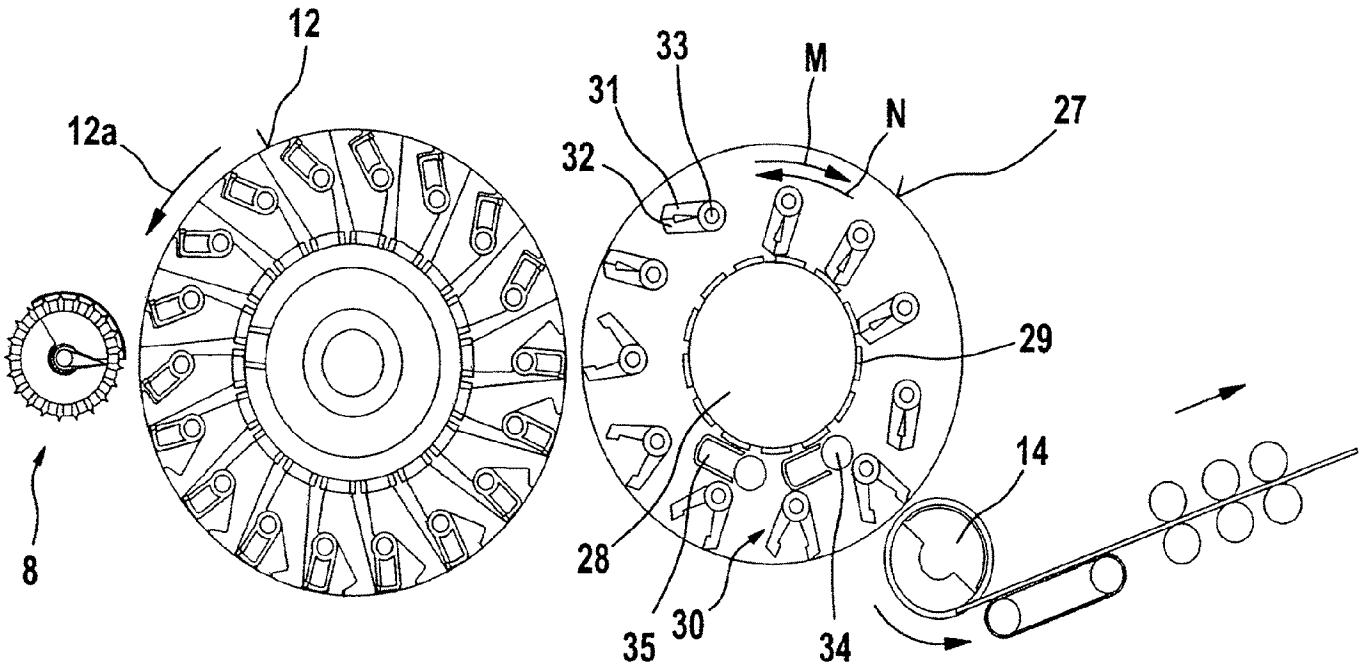
FIG. 2 shows a further embodiment of the rotor combing machine according to the invention with two rollers, in which nipper devices are present on the first roller and a roller with combing elements is arranged inside the second roller.

In the embodiment of FIG. 2, a second construction of the rotor combing machine of the invention has two rollers, the first roller 12 (turning rotor) being constructed as illustrated in and described with reference to FIG. 1. The fibre bundle is transferred from the first roller 12 onto a second roller 27 (combing rotor). Inside the second roller 27, a further roller 28 equipped with a plurality of combing elements 29 rotates. The roller 28 is mounted concentrically with respect to the axis of the second roller 27. The roller 28 rotates continuously and uniformly in the same direction as or the opposite direction to the combing rotor 32. The nipper devices 30 consist of an upper nipper 31 and a lower nipper 32, which with their one end are rotatable about a pivot bearing 33 in directions M, N. In the closed state, the nipper devices 30 present the clamped fibre tufts to the combing elements 29 for combing. Through the relative movement between fibre tuft and combing element 29 the fibre tuft is combed. Inside the rotor 27 there is a cleaning device, for example, a rotating cleaning roller 34 with extractor hood 35, which cleans the combing elements 29. In the case of same-direction combing, the speed ratio between combing rotor 27 and the roller 28 with combing elements 29 is greater than 1. The combed-out fibre bundle passes from the combing rotor 27 onto the piecing roller 14.

Figure 3:
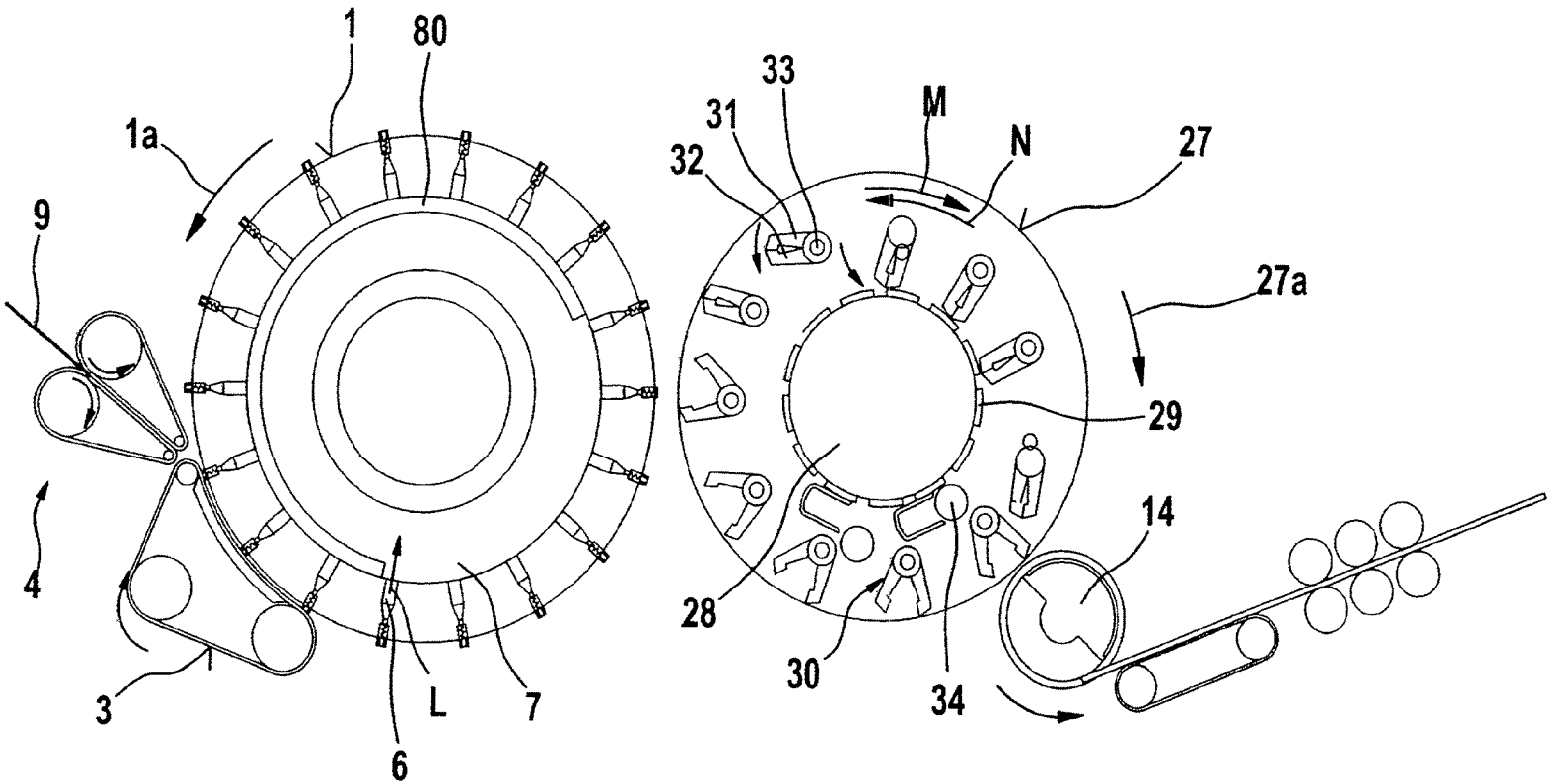
FIG. 3 shows a third embodiment of the rotor combing machine according to the invention, in which on the first roller counter-elements are arranged lying opposite the nipper devices and a roller with combing elements is arranged inside the second roller.

In the embodiment of FIG. 3, on the first roller 1 (turning rotor) clamping elements are present, opposite which a conveyor belt 3 is arranged as counter-element, wherein the fibre sliver is held partly by suction on the first roller 1. The fibre material 9 is fed by a supply device 4 comprising two co-operating endlessly revolving conveyor belts into the gap between the roller 1 and the conveyor belt 3. Through clamping between the clamping elements and the belt portion of the conveyor belt 3 facing towards the roller 1, fibre sliver bundles are formed (detached) and carried out of the gap between the roller 1 and the conveyor belt 3. Subsequently an end region of each sliver bundle is firmly held on the surface of the roller 1 by a suction air current L of a suction channel 6, which is connected to a reduced pressure region 7. In a subregion, primarily from the transfer point between the first roller 1 and the second roller 27 as far as delivery of the fibre bundle from the gap between first roller 1 and counter-element 3—a screen element 80 effects closure of the suction openings of the suction channels 6. The fibre bundle is subsequently transferred onto the second roller 27 (combing rotor). The second roller 27 corresponds to the roller 27 illustrated in and described with reference to FIG. 2.

Figure 4:
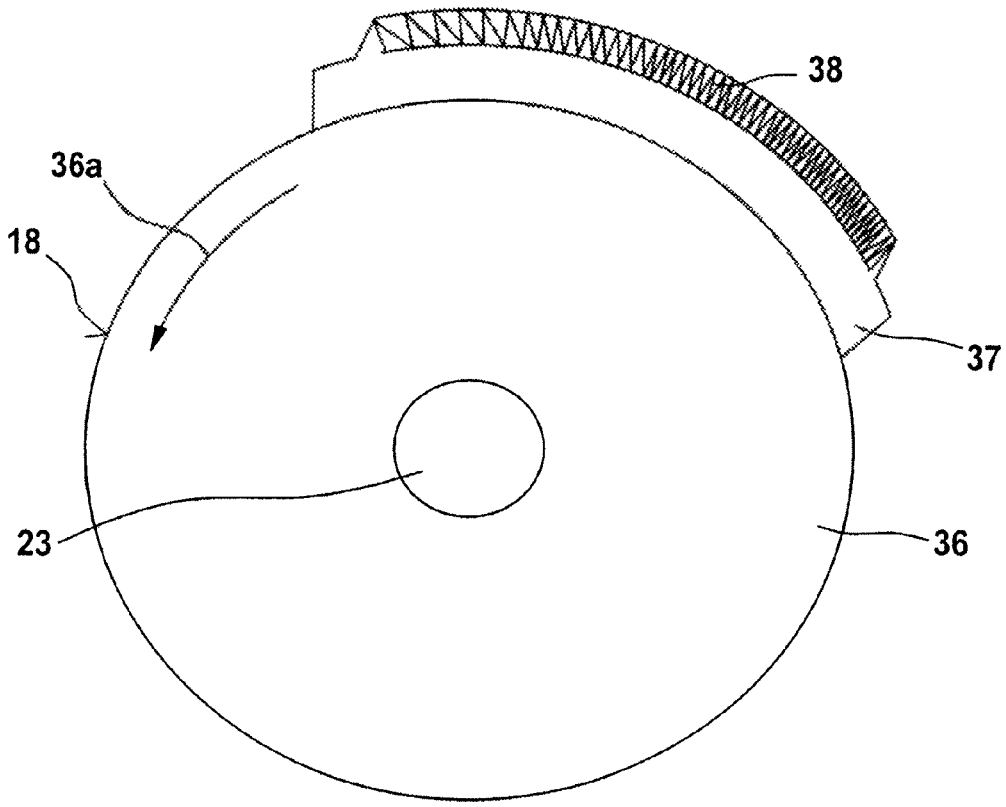
FIG. 4 is a diagrammatic side view of a circular comb.

FIG. 4 shows a circular comb 18, suitable for use in a rotorcombing machine such as that described with reference to FIG. 1. A circular comb carrier 36 is mounted, secured against rotation, on a circular comb shaft 23 by fixing means (not shown). A base plate 37 is secured via fixing means (not illustrated) to the outer surface of the circular comb carrier 36. Differently constructed rows of toothed clothings 38 are mounted on the base plate 37. The toothed clothings 38, e.g. saw-tooth wire strips (all-steel clothings) collectively form a combing segment. The toothed clothings 38 are secured to the base plate by adhesion, positive connection, non-positive connection or in some other way. The circular comb rotates in direction 36*a*. The combing elements 29 (see FIG. 3) can be correspondingly constructed. The toothed clothings 38 are convexly oriented.

In a fourth embodiment (not shown) of the rotor combing machine according to the invention, the first roller 1 is constructed as illustrated in and described with reference to FIG. 3 and the second roller 15 is constructed as illustrated in and described with reference to FIG. 1.

In use of the rotor combing machine according to the invention there is achieved a mechanical combing of the fibre material to be combed out, that is, mechanical means are used for the combing. There is no pneumatic combing of the fibre material to be combed, that is, no air currents, e.g. suction and/or blown air currents, are used for combing.

The circumferential speeds are, for example, for the feed roller about from 0.2 to 1.0 m/sec; the first roller 12 about from 2.0 to 6.0 m/sec; the second roller 13 about from 2.0 to 6.0 m/sec; the doffer about from 0.4 to 1.5 m/sec; and the revolving card top assembly about from 1.5 to 4.5 m/sec. The diameter of the first roller 12 and the second roller 13 is, for example, about from 0.3 m to 0.8 m.

Using the rotor combing machine 2 according to the invention, more than 2000 nips/min, for example from 3000 to 5000 nips/min, are achieved.

In the rotor combing machine according to the invention there are present rollers that rotate rapidly without interruption (continuously) and that have clamping devices. Rollers that rotate with interruptions, stepwise or alternating between a stationary and rotating state are not used.

Although the foregoing invention has been described in detail by way of illustration and example for purposes of understanding, it will be obvious that changes and modifications may be practised within the scope of the appended claims.

What is claimed is:

1. An apparatus for the fibre-sorting or fibre-selection of a fibre bundle comprising textile fibres, the apparatus comprising:

a fibre-sorting device;

a supply device adapted to supply the fibre bundle to the fibre-sorting device; and at least one mechanical combing device adapted to generate a combing action in order to loosen and remove non-clamped constituents from the fibre bundle;

wherein the fibre-sorting device comprises:

a first roller and a second roller arranged downstream of the supply device, wherein, in use, the first roller and the second roller rotate rapidly without interruption, and clamping devices distributed spaced apart in a peripheral region of at least one of the first roller or the second roller, wherein the mechanical combing device is arranged inside at least one of said first roller or second roller.

2. An apparatus according to claim 1, wherein said first roller comprises a turning rotor and said second roller comprises a combing rotor.

3. An apparatus according to claim 2, wherein the mechanical combing device is arranged inside the combing rotor, and comprises a plurality of combing elements.

4. An apparatus according to claim 3, having clamping devices that co-operate with the combing elements.

5. An apparatus according to claim 3, in which each combing element is rotatable about its own pivot point.

6. An apparatus according to claim 3, wherein the combing rotor pivots about a pivot point, and all of the combing elements rotate about the pivot point of the combing rotor.

7. An apparatus according to claim 3, wherein the combing rotor pivots about a pivot point, and the combing elements rotate both individually around their own pivot point and, as a group, around the pivot point of the combing rotor.

8. An apparatus according to claim 6, wherein the combing elements are arranged on a further rotating roller arranged inside the combing rotor.

9. An apparatus according to claim 8, in which the axes of rotation of the rotating roller and the combing rotor are arranged concentrically with respect to one another.

10. An apparatus according to claim 2, wherein the combing rotor has a plurality of clamping devices which clamp a fibre bundle at a distance from its free end, and each clamping device comprises a gripper element and a counter-element, and at least one of the gripper element or the counter element is rotatably mounted on the clamping device.

11. An apparatus according to claim 2, wherein the combing rotor pivots about a pivot point, and the clamping devices each rotate around their own pivot point and all of the clamping devices rotate around the pivot point of the combing rotor.

12. An apparatus according to claim 2, in which at least one combing element is associated with each clamping device of the combing rotor.

13. An apparatus according to claim 3, in which the or each combing element has a combing clothing on all or a part of its periphery.

14. An apparatus according to claim 3, comprising circular combs as combing elements.

15. An apparatus according to claim 3, comprising combing rollers as combing elements.

16. An apparatus according to claim 3, in which the combing elements are rotatable.

17. An apparatus according to claim 3, in which a gripper element movable in rotation and a rotatable combing element are arranged side by side.

18. An apparatus according to claim 1, wherein the mechanical combing device comprises a clothed combing roller, and said clamping devices comprise an immovable gripper element arranged side by side with said clothed combing roller.

19. An apparatus according to claim 3, further comprising a wheel gear which is usable for rotation of combing elements associated with the combing rotor, the wheel gear being driven by the combing rotor.

20. An apparatus according to claim 8, wherein the further rotating roller is mounted concentrically with respect to the axis of the combing rotor.

21. An apparatus according to claim 8, wherein the further rotating roller is mounted eccentrically with respect to the combing rotor.

22. An apparatus according to claim 8, wherein the further rotating roller and the combing rotor have the same direction of rotation.

23. An apparatus according to claim 8, wherein the further rotating roller and the combing rotor have different directions of rotation.

24. An apparatus according to claim 3, wherein the clamping devices each comprise an upper nipper and a lower nipper, wherein when the upper nipper and lower nipper are in a closed state, the upper nipper and lower nipper present the clamped fibre bundles to the combing device for combing.

25. An apparatus according to claim 2, wherein the mechanical combing device is rotatable in the same direction as the combing rotor, and a speed ratio between the combing rotor and the mechanical combing device is greater than 1 during combing.

* * * * *